12/4/79 XR 4,177,316

United States Patent [19]

Diegelmann et al.

[11] 4,177,316

[45] Dec. 4, 1979

[54] IMPREGNATED CARBON BRUSH FOR ELECTRICAL MACHINERY

[75] Inventors: Winfried Diegelmann, Heuchelheim; Günter Schardt, Giessen; Jochen Klatt, Krofdorf-Gleiberg; Heinz Grölz, Staufenberg, all of Fed. Rep. of Germany

[73] Assignee: Schunk & Ebe GmbH, Postfach, Fed. Rep. of Germany

[21] Appl. No.: 827,612

[22] Filed: Aug. 25, 1977

[51] Int. Cl.[2] ..... H01R 39/22; B05D 5/12; H01R 39/26

[52] U.S. Cl. ..... 428/367; 252/11; 252/12.2; 252/502; 252/510; 427/114; 428/408; 428/422

[58] Field of Search ..... 428/367, 408, 422; 252/11, 12.2, 502, 510; 427/114, 289, 294, 298

[56] References Cited

U.S. PATENT DOCUMENTS

| | | | |
|---|---|---|---|
| 2,881,100 | 4/1959 | Hardman | 427/113 |
| 3,455,864 | 7/1969 | Dodson | 252/12.2 X |
| 3,751,294 | 8/1973 | Fridman et al. | 427/114 |
| 3,956,568 | 5/1976 | Kanemaru et al. | 428/408 |
| 3,992,725 | 11/1976 | Homsy | 428/408 X |
| 3,996,408 | 12/1976 | Fridman et al. | 428/408 |
| 4,080,233 | 3/1978 | McCloskey | 252/12.2 X |
| 4,140,832 | 2/1979 | Menegay | 427/114 X |

*Primary Examiner*—Harold Ansher
*Attorney, Agent, or Firm*—Max Fogiel

[57] ABSTRACT

An impregnated carbon brush for electrical machinery with improved running properties and increased wear-resistance, in which the carbon brush has an impregnating medium containing non-melting grease, and/or a non-melting wax, and/or a non-flowing oil. The impregnating medium in the carbon brush is on a synthetic, mineral, animal or vegetable base which is thoroughly mixed with a gelatinizing agent on an inorganic and/or organic base and thereby transformed to a non-melting or non-flowing harder and more wear-resistant condition. The gelatinizing agent contained in the carbon brush as a component of the impregnating medium comprises montmorillonite flakes with surfaces coated with long-chain hydrocarbons. The carbon brush includes additives for improving the sliding properties in the form of inorganic and/or organic additives such as metal sulfides, metal oxides and PTFE powder. The carbon brush contains 0.1 to 25% by weight of impregnation medium relative to the weight of the impregnated carbon brush.

6 Claims, No Drawings

IMPREGNATED CARBON BRUSH FOR ELECTRICAL MACHINERY

BACKGROUND OF THE INVENTION

The present invention relates to an impregnated carbon brush with improved running properties and increased wear resistance for current pickup (collecting) devices on electrical machinery. Carbon brushes from hard-burnt carbon or electrographite are frequently impregnated with various organic or inorganic substances or mixtures, with the purpose of impregnation varying. Ordinarily, however, an improvement of running properties and increase in life of the brushes is to be achieved.

The purpose of impregnating the brushes with greases, oil or waxes is to produce a lubricant film on the collector running surface or on the slip ring. This improves the running behavior and reduces the wear. However, in many cases this improvement is not sufficient since, even when using high-melting greases or waxes the beneficial effect is present only for a limited period, e.g., when increased operating temperatures are present. In such cases, these means act mainly as start-up aids since they become liquid after a relatively short time due to the effect of temperature and leave the brushes. Another disadvantage with intermittent operation is a freezing of the brushes on the holder walls due to the impregnating medium having left.

It is, therefore, an object of the present invention to create a carbon brush which avoids these disadvantages and which contains an impregnating medium that does not depart during the entire running time of the brush even at increased operating temperatures.

Another object of the present invention is to provide a carbon brush of the foregoing character which may be economically fabricated and has a substantially long operating life.

SUMMARY OF THE INVENTION

The objects of the present invention are achieved by providing that the carbon brush has an impregnating medium containing a non-melting wax and/or a non-flowing oil. The impregnating medium located in the carbon brush comprises a grease, wax or oil on a synthetic, mineral, animal or vegetable base which is thoroughly mixed with a gelatinizing agent on an inorganic and/or organic base and thus has been converted to a non-melting or non-flowing harder and wear resistant condition.

Preferably, the gelatinizing agent used as a component of the impregnating medium comprises montmorillonite flakes whose surfaces are covered with long-chain hydrocarbons.

The carbon brush may also contain inorganic and/or organic additives which improve the sliding properties and are components of the impregnating medium. Additives might be metal sulfides, metal oxides or PTFE powder.

To produce carbon brushes in accordance with the present invention, carbon material such as hard-burnt carbon or electrographite is produced in the conventional manner and then impregnated by practicing the vacuum-pressure method. The impregnating medium used comprises a cold 0.1 to 30% by weight solution or dispersion of a non-melting grease and/or non-melting wax and/or a non-flowing oil in a halogenated hydrocarbon, e.g., trichloroethylene. Impregnation medium remainders adhering to the surface of the carbon material are rinsed off by immersion in hot trichloroethylene. Then the carbon bodies are dried at about 80° C. in order to drive out the solvent. The impregnating medium portion remaining in the carbon material is 0.1 to 25% by weight, relative to the weight of the impregnated carbon material.

DESCRIPTION OF THE PREFERRED EMBODIMENTS

To explain the invention, the following will describe the type of impregnating material in detail. The base of the impregnating medium in a grease, wax or oil on synthetic, mineral, animal or vegetable base. By adding an organic and/or inorganic gelatinizing agent, thorough mixing of both components being indispensable, it is modified so that at higher temperatures it retains its stability and viscosity, hence does not melt or flow out. The production of such non-melting greases, waxes or oils is known, but use as impregnating medium for carbon brushes is new. Technical progress (improvement) becomes clear from the fact that there is no impregnating medium outflow even at an operating temperature of 300° C. while conventional impregnating media leave the brush after a relatively short time at about 150° C. and the beneficial action on the running behavior is no longer available.

The beneficial effect of the brushes impregnated in accordance with the present invention is demonstrated by the following experimental results.

In a test on a small-carbon/test machine, brushes of the same carbon quality were tested:

1. unimpregnated brushes
2. brushes impregnated with high-melting paraffin
3. brushes impregnated with non-melting grease in accordance with the present invention.

The brushes ran at a current density of 6 amp./cm on a short-circuited collector with the speed being varied in steps. The measured items were the collector temperature, the brush wear and the friction coefficient. The results listed in Table 1 clearly show the advantage of the impregnation in accordance with the invention for the mechanical running behavior of the carbon brushes. For example, the carbon brush impregnated according to the invention, at a peripheral collector speed of 20 m/sec, has a wear of only 2 μm/hr, while the carbon brush impregnated with paraffin has a wear of 6 μm/hr. The table shows that with a peripheral speed of 40 or 50 m/sec, only the carbon brush of the invention can be used.

Table 1

Results of Run Tests

| brush material | 1. unimpregnated | | | 2. impregnated with paraffin | | | 3. impregnated with non-melting grease | | |
|---|---|---|---|---|---|---|---|---|---|
| Item measured Peripheral speed | coll. temp. °C. | brush wear μm/h | friction coeff. | coll. temp. °C. | brush wear μm/h | friction coeff. | coll. temp. °C. | brush wear μm/h | friction coeff. |
| 20 | 115 | 7.3 | 1.8 | 110 | 6.0 | 1.4 | 70 | 2.0 | 0.09 |

Table 1-continued

| Results of Run Tests | | | | | | | | | |
|---|---|---|---|---|---|---|---|---|---|
| brush material | 1. unimpregnated | | | 2. impregnated with paraffin | | | 3. impregnated with non-melting grease | | |
| Item measured Peripheral speed | coll. temp. °C. | brush wear μm/h | friction coeff. | coll. temp. °C. | brush wear μm/h | friction coeff. | coll. temp. °C. | brush wear μm/h | friction coeff. |
| 30 | 150 | 10.7 | 2.4 | 135 | 8.7 | 1.9 | 80 | 2.7 | 1.1 |
| 40 | 200 | 18.3 | 3.3 | 190 | 13.3 | 2.6 | 120 | 8.3 | 1.4 |
| 50 | | | | | | | 175 | 15.0 | 1.8 |

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An impregnated carbon brush for electrical machinery for improved running properties and increased wear-resistance, said carbon brush having an impregnating medium selected from the group of a non-melting grease, a non-melting wax, and a non-flowing oil; said impregnating medium being obtained by thoroughly mixing a medium selected from a group of grease, wax and oil with montmorillonite flakes having surfaces coated with long-chain hydrocarbons, and thereby being converted to a non-melting or non-flowing condition.

2. The carbon brush as defined in claim 1 wherein the carbon brush includes additives for improving sliding properties.

3. The carbon brush as defined in claim 1 wherein the impregnating medium in the carbon brush includes additives such as metal sulfides, metal oxides and polytetrafluoroethylene powder for improving sliding properties.

4. The carbon brush as defined in claim 1 wherein the carbon brush contains 0.1 to 25% by weight of impregnation medium relative to the weight of the impregnated carbon brush.

5. An impregnated carbon brush as defined in claim 1 wherein the chemical composition of said impregnating medium is unchanged by said montmorillonite flakes, said impregnating medium being deposited on said flakes and forming with said flakes a gel having particles adhering to each other at different points.

6. An impregnated carbon brush as defined in claim 1 wherein said impregnating medium in the carbon brush is on a base which is thoroughly mixed with a gelatinizing agent and thereby transformed to a non-melting or non-flowing harder and more wear-resistant condition, said gelatinizing agent comprising said montmorillonite flakes having surfaces coated with long-chain hydrocarbons, said gelatinizing agent being contained in the carbon brush as a component of the impregnating medium, said impregnating medium including additives for improving sliding properties, said additives comprising additives such as metal sulfides, metal oxides and polytetrafluoroethylene powder, said carbon brush containing 0.1 to 25% by weight of impregnation medium relative to the weight of the impregnated carbon brush; the chemical composition of said impregnating medium being unchanged by said montmorillonite flakes, said impregnating medium being deposited on said flakes and forming with said flakes a gel having particles adhering to each other at different points.

* * * * *